United States Patent [19]

Gerstner-Stevens et al.

[11] Patent Number: 4,943,009

[45] Date of Patent: Jul. 24, 1990

[54] PLYING OR DOUBLING MACHINE

[75] Inventors: Ditmar Gerstner-Stevens, Obertshausen; Josef Schrod, Eppertshausen, both of Fed. Rep. of Germany

[73] Assignee: Karl Mayer Textilmaschinenfabrik GmbH, Obertshausen, Fed. Rep. of Germany

[21] Appl. No.: 324,304

[22] Filed: Mar. 16, 1989

[30] Foreign Application Priority Data

Mar. 17, 1988 [DE] Fed. Rep. of Germany ..... 3808957

[51] Int. Cl.[5] ..... B65H 54/00; B65H 63/024

[52] U.S. Cl. ..... 242/42; 242/35.6 E; 242/38

[58] Field of Search ..... 242/42, 38, 40, 36, 242/35.6 R; 57/261

[56] References Cited

U.S. PATENT DOCUMENTS 2,740,591 4/1956 Woods ..... 242/38
3,794,252 2/1974 Abbott ..... 242/38

FOREIGN PATENT DOCUMENTS 363274 8/1962 Switzerland ..... 242/38
406930 8/1966 Switzerland ..... 242/42

*Primary Examiner*—Stanley N. Gilreath
*Attorney, Agent, or Firm*—Omri M. Behr

[57] ABSTRACT

In a plying machine at least two original threads are taken from run-off spools and are together wound as a doubled thread over a plying spool. The machine has a magazine for replacing one of the run-off spools with at least one reserve spool. A thread watcher can sense the presence and absence of the original threads along predetermined respective paths and can provide in response thereto a watcher signal. A common cutter can concurrently cut the original threads. The machine has a knotter for binding together the original threads and the doubled thread. The knotter is positioned, at least when binding, at at least one predetermined position on the machine. A plurality of guides, each having a thread grasper, can provide the original threads and the doubled thread to the knotter. Also included is a controller coupled to the cutter, to the knotter and to at least one of the guides for automatically operating them in response to the watcher signal.

9 Claims, 3 Drawing Sheets

PLYING OR DOUBLING MACHINE

The present invention is directed to a plying or doubling machine which takes two or more threads from each of the appropriate run-off spools. Each of the threads are run through a thread watcher and wound together onto a plying spool and wherein a combining arrangement can bind all threads together.

A plying machine of the foregoing type is, for example, known from the German publication by Schneider, "Achinen Furdie Weberer" (1963) pages 107 to 111. This machine produces plied spools on which two, three or more threads are spooled together without being twisted together, which would be required for their further processing in a twisting machine. The run-off spools can be cylindrical or conical spools, which are principally formed on automatic cross-spooling machines which at the same time, eliminates the formation of faults. The run-off spools can also be provided in the form of cops, in this case the plying machine is further provided with thread cleaners.

The run-off spools are provided with core holders. When a thread watcher reports the absence of a thread the plying machine is braked. A service person replaces the empty run-off spool with a full run-off spool and makes the necessary binding of the threads by means of a manually activatable combining arrangement, that is, a hand knotter or hand splicer. This requires that the threads must first be grasped by hand and placed into the combining arrangement. This consumes much time which has had a negative effect on the efficiency of plying machines and requires a substantial use of service people.

Spooling automats are also known ( DE-PS 1785293) which only take up one individual thread. In this equipment a single take-off spool may be automatically replaced by a reserve spool from a magazine, when the thread watcher reports the absence of the run-off thread. Guiding arrangements grip the beginning of the reserve thread and the thread end located on the run-off spool and lay both of them on a combining arrangement which may be fixed or moveable upon a predetermined path (knotters or splicers). The combination then proceeds automatically.

SUMMARY OF THE INVENTION

In accordance with illustrative embodiments demonstrating features and advantages of the present invention, there is provided a plying machine wherein at least two original threads are taken from run-off spools and are together wound as a doubled thread over a plying spool. The machine has a magazine for replacing one of the run-off spools with at least one reserve spool. The machine also has a thread watching means for sensing the presence and absence of the original threads along predetermined respective paths and for providing in response thereto a watcher signal. Also included is a common cutting means for concurrently cutting the original threads. The machine also has a combining means for binding together the original threads and the doubled thread. The combining means is positioned, at least when binding, at at least one predetermined position on the machine. The machine includes a plurality of guiding means, each having a thread grasping means, for providing the original threads and the doubled thread to the combining means. Also included is a control means coupled to the cutting means, to the binding means and to at least one of the guiding means for automatically operating them in response to the watcher signal.

One purpose of the present invention is to provide a plying machine which is automated in a greater degree then was known heretofore.

Advantages arises from several significant features of preferred embodiments: (a) at least one magazine is provided for delivering at least one reserve spool; (b) all threads share a single cutting arrangement; (c) the combining arrangement, at least for the combining step, is located at a predetermined location on the machine; (d) guiding arrangements are provided which are at least to a certain extent provided with thread grippers which act together to lay the threads to be combined in the combining arrangement; and (e) the cutting arrangements, the guiding arrangements and the combining arrangements are automatically activatable upon signals obtained from a thread watcher.

By utilizing a magazine with reserve spools and in consequence of the automatic combining arrangement, downtimes are considerably reduced. This leads to a considerable improvement in the quality of operation. Furthermore, the need for service personnel is small, since service personnel need only fill the reserve spools into the magazine (in so far as this does not occur automatically in the disclosed embodiment).

By using a common cutting arrangement, through which the several threads run, it is possible after a cut across the thread-run direction, to achieve a unitary strand end formed from several threads. This end can also be grasped by the use of thread grippers of the appropriate guide arrangement. Consequently, substantially trouble free operation of a plying machine is facilitated.

It is preferable if this magazine is provided with a transport arrangement with a drive which is activatable upon signals from the appropriate thread watcher, to transport the reserve spool into a predetermined position. This automatically ensures that each of the operative run-off spools is always in the same position so that the thread has a predetermined path.

In addition, each transport band can be provided with core holders for each run-off spool and at least one reserve spool. These transport bands can be loaded at one end and discharge empty cops at the other end.

It is particularly desirable to provide a control arrangement which activates the cutting arrangement when the thread end of a now empty run-off spool finds itself in the vicinity of the cutting arrangement. This control arrangement makes sure that from any given thread end, no end or at least only a very short end, is cut off. Thus, there is no danger of making segments of longer length, which could lead to undesired entanglements.

It is desirable to provide the guide arrangements with suction tubes whose suction jets form the thread grippers. Such guide arrangements have been found useful in simple automatic spooling machines.

At least the first guide arrangement can be installed near the transport arrangement of the magazine with a rigidly placed thread gripper for grasping the beginning thread ends of at least one reserve spool in the magazine immediately following the run-off spools. In the simplest case, the threads can be brought manually to such a thread gripper when the reserve spool is loaded into the magazine.

It is advantageous to provide a second guiding arrangement whose thread gripper is located near the cutting arrangement for grasping the ends of each cut thread still connected with the run-off spool. This serves to insure that the threads still attached to the run-off spool are properly held after the cutting step.

It is furthermore advantageous to provide yet a third guide arrangement in the vicinity of the take-up spool, having a thread gripper at the end thereof to grasp the thread ends already on the take-up spool. With the assistance of such a thread gripping means, the common end of a doubled thread can be grasped in the same way as the end of a single thread.

In a particularly desired embodiment, all threads are provided with a common thread cleaner. It is also preferred that the thread cutting arrangement and the guiding arrangements (with the exception of the one for thread ends of the reserve spool) and the binding arrangement are automatically activatable upon signals from the thread cleaner or thread watcher. This makes it possible to run the plies through a substantially automatic working process wherein cops are used as run-off spools. This enables substantial parts, which are also necessary for the automatic spool change, to be utilized for eliminating faults in the threads.

BRIEF DESCRIPTION OF THE DRAWINGS

The invention is described in connection with the preferred embodiments illustrated in the drawings, wherein.

DETAILED DESCRIPTION OF THE PREFERRED EMBODIMENTS

Figure 1:
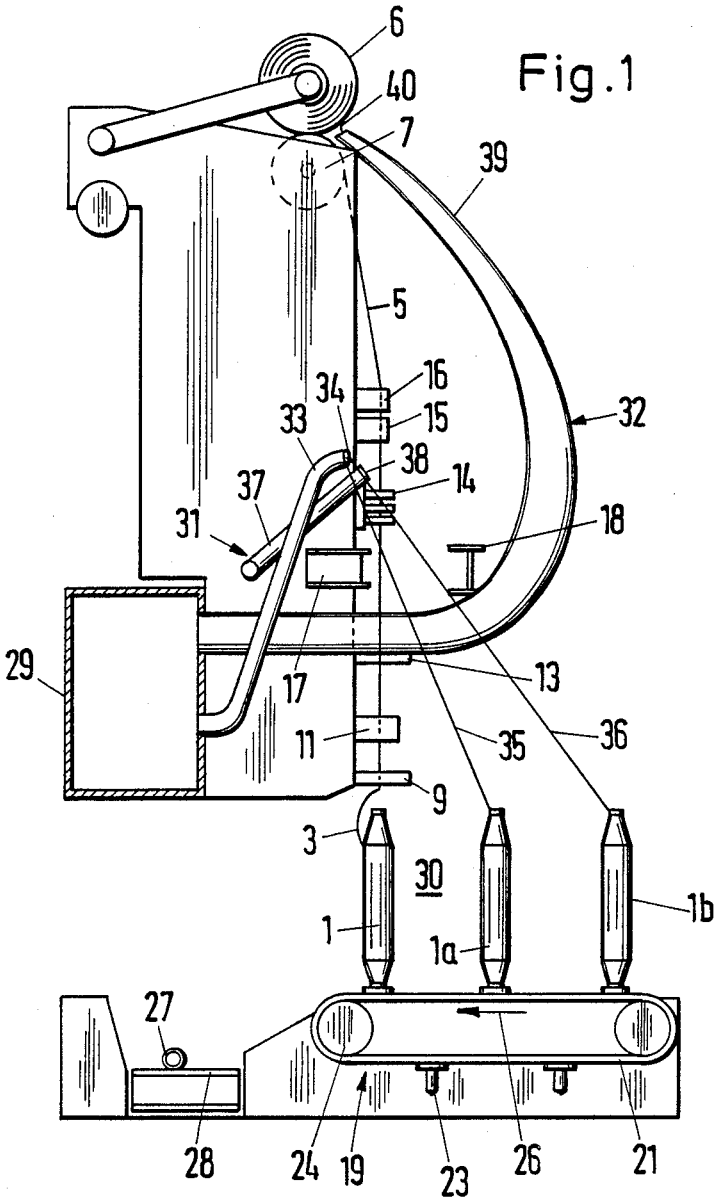
FIG. 1 is a schematic, side elevational view of a spooling machine in accordance with the present invention.
Figure 2:
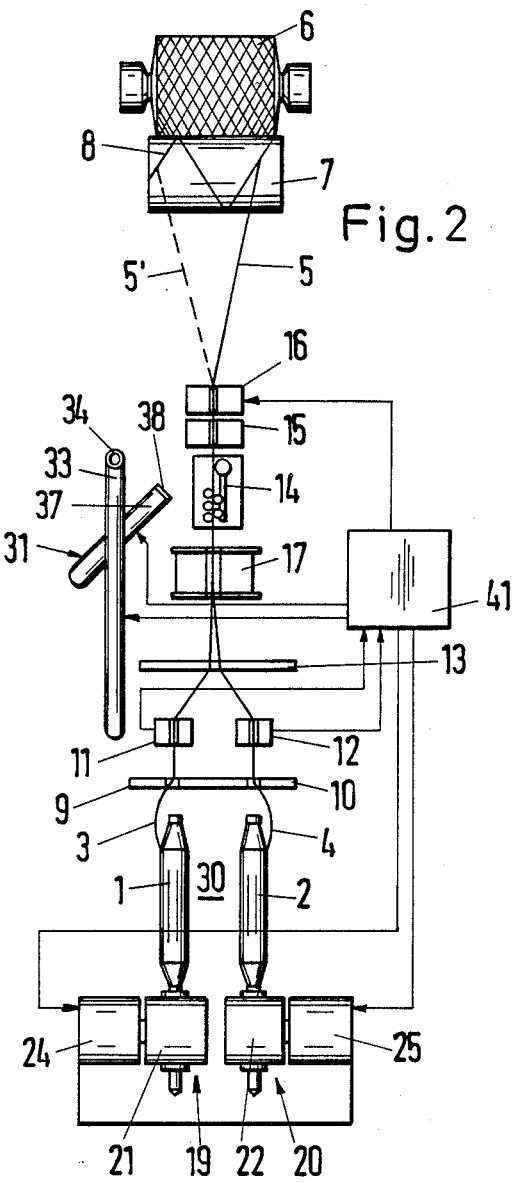
FIG. 2 is a front elevational view of the device of FIG. 1.

Referring to FIGS. 1 and 2, from two run-off spools 1 and 2 which are in the form of cops, original threads 3 and 4, respectively, are taken off and combined into a unitary doubled thread 5 on a take-up spool 6, in the form of a cross-spool. The latter is driven by thread-drive drum 7 which, by means of a guide groove 8, axially reciprocates combined strand 5 between setting 5 shown in full line and setting 5′ shown in phantom.

Both threads 3 and 4 pass through balloon limiters 9 and 10 and the appropriate electronic thread watchers 11 and 12. Thread watchers 11 and 12 may be slotted fixtures have photo-optical sensors (phototransistors, for example) for providing a watcher signal indicating the presence or absence of original threads 3 or 4. The two threads 3, 4 are led through an open eyelet 13 to be brought close enough together to be handled as a single strand 5, which then passes through a thread brake 14, thread cleaner 15 of a electronic cleaning means, and common cutting arrangement 16. Cutting arrangement 16 can be electrically activated to cut threads within it.

Between eyelet 13 and thread brake 14 there is located a fixed combining means 17, which is provided with conventional thread inlay levers 18. Combining means may be one of any known knotters capable of combining threads by either a knot or by entangling threads to form a continuing thread.

Each run-off spool 1 and 2 is provided with a magazine 19 and 20, respectively, located on transport bands 21 and 22 equipped with core holders 23 and driveable in the direction of arrow 26 by drive means 24 and 25. The drive means are provided in the form of stepping motors but can also be formed with mechanical drives having clutch means. The core holders carry not only the above described run-off spools 1 and 2 but further reserve spools of which reserve spools 1*a* and 1*b* of magazine 19 are illustrated. When the run-off spool 1 is empty, the transport 19 is moved so that the first reserve spool 1*a* arrives into the spooling position. At the same time the empty core of the previous run-off spool 1 falls into removal transportation channel 28. Further reserve spools can then be placed onto the core holders 23 either by hand or by automatic means.

The machine is further provided with a suction channel 29 provided with three guide arrangements 31, 32 and 33, operating at a pressure below atmospheric.

The first guide arrangement 33 is formed near the transport bands 21 and 22. Arrangement 33 is shown employing a suction tube connected to suction channel 29 and ending in suction jets which form the thread gripper 34. The position of arrangement 33 is adjustable, but remains in a fixed position during operation.

Thread gripper 34 holds the beginning thread ends of reserve threads 35 from reserve spool 1*a* following run-off spool 1, a well as the reserve threads 36 of the further reserve spool 1*b*. The threads of corresponding reserve spools (not shown) on band 22 are also held in gripper 34. By activation of the transport bands 21 and 22, reserve thread 35 of the activated magazine is brought to the combining means 17.

The second guide arrangement 31 (shown in a fragmentary view but connecting nevertheless to channel 29) comprises a suction tube 37 whose suction jet forms thread gripper 38. Thread gripper 38 is found in the vicinity of the cutting arrangement 16 and may be utilized to take up the cut thread ends to be found below the cutting knife, which are still connected with run-off spools 1 and 2. Suction tube 37 is pivotable about its lower end so that the grasped thread ends can be brought to the combining means 17. The previously mentioned thread inlay levers 18 bring the thread ends into the combining means 17 in the manner previously described.

Figure 3:
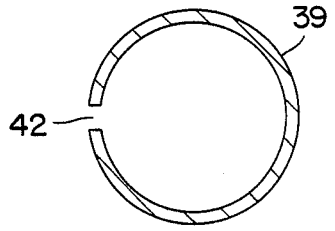
FIG. 3 is a cross-sectional view of the tube of FIG. 1 taken along line III—III of that figure.

The third guide arrangement 32 comprises a curved suction tube 39 communicating with channel 29 and extending upwardly. The upper end of tube 39 terminates in thread gripper 40 in the form of a suction jet having an orifice stretching next to across the entire width of take-up spool 6. Gripper 40 serves to grasp the common end of a cut thread strand 5 on the periphery of take-up spool 6, when this spool is turned slowly in the reverse direction. Suction tube 39 is provided, in normal fashion, with a slit on the inner side of the curve so that the thread end 5*a*, which was pulled in the direction of suction channel 29, emerges through a slot 42 (FIG. 3) when the suction is reduced or eliminated. In this way thread end 5*a* comes to lie in front of the combining means 17.

Control arrangement 41 is connected to the output of thread watchers 11 and 12. Control arrangement 41 is connected to the control terminals of cutter 16, drive means 24, 25, and guide arrangements 31, 32 and 33 (connection to guide 32 not shown), to operate them. Control arrangement 41 is activated when thread watcher 11 or 12 determines the absence of an appropriate thread 3 or 4, indicating that the appropriate run-off spool 1 or 2 is empty. After a predetermined time, the control arrangement 41 activates the cutting arrangement 16. The time is selected according to the distance between the thread watchers 11, 12 and the cutting arrangement 16, as well as the thread winding speed. Based on these kinetic factors, the cutting time can be calculated so that the cut occurs at or prior to the arrival of the thread end from the empty run-off spool at the cutting arrangement 16. There is thus obtained, a cut thread 5 whose thread strands are substantially similar in length, thereby avoiding undesired entanglements due to longer thread ends wandering about in an uncontrolled manner. The common thread ends can be readily gripped by thread gripper 40 when the thread drum 7 and the take-up spool 66 is braked and run backwards.

Control arrangement 41 also activates the three guide arrangements 31, 32 and 33 as is shown by the direction of the function arrows (except arrangement 32). Thus all of the suction tubes 33, 37, 39 are activated under reduced pressure. Also at this time drive means 24 and 25 turn transport arrangement 21 and 22 in order to bring the reserve spool 1*a* into the spooling position.

If one assumes that run-off spool 1 is to be replaced, the reserve thread 35 from reserve spool 1*a* is already held by first guide arrangement 33. After cutting, the freshly cut end of thread 4 is grasped and kept from falling or going astray by the second guiding arrangement 31. Also, the end of the doubled thread 5 is grasped by guide arrangement 32 and drawn through tube 39 as the reel 6 reverses direction. Thereafter the pressure in tube 39 can be eliminated so thread 5*a* emerges from slit 42 to reach combining arrangement 17. Then the control arrangement 41 activates this combining arrangement 17 so that the aforementioned threads are knotted or spliced together.

A sensor in thread cleaner 15 determines the presence of irregularities in the thread strand 5 and appropriately activates the cutting arrangement 16. The guide arrangements 31 and 32 are then activated in order to bring the individual threads together again. One can utilize, if desired, several thread cleaners which are directed to individual threads 3 and 4. By use of electronic sensors the function of the cleaner and the thread watchers can also be combined with each other.

The illustrated embodiment shows a plying machine for use with two threads. It is possible, however, to provide for three or more threads which, of course, requires provision of an appropriate additional number of magazines.

We claim:

1. A plying machine wherein at least two original threads taken from run-off spools are together wound as a doubled thread over a plying spool, comprising:

a magazine for replacing one of said run-off spools with at least one reserve spool;

thread watching means for sensing the absence of said original threads along predetermined respective paths and for providing in response thereto a watcher signal;

a common cutting means for concurrently cutting said original threads;

a combining means for binding together said original threads and said doubled thread, said combining means being positioned, at least when binding, at at least one predetermined position on the machine;

a plurality of guiding means, each having a thread grasping means, for providing said original threads and said doubled thread to said combining means; and control means coupled to said cutting means, to said binding means and to at least one of said guiding means for automatically operating them in response to said watcher signal.

2. A plying machine in accordance with claim 1 wherein said magazine comprises:

a transport means having a drive means for carrying said reserve spool into a predetermined spool position, in response to said watcher signal.

3. Spooling machine in accordance with claim 2 wherein said transport means is band-shaped and wherein said magazine further comprises:

a plurality of core holders mounted on said transport means for holding said run-off and reserve spools.

4. Plying machine in accordance with claim 1 wherein said control means is operable to time said cutting means to cut when an end of one of said original threads, after leaving one of said run-off spools, arrives in the vicinity of the cutting means.

5. Plying machine in accordance with claim 1 wherein each of said guiding means comprise a suction tube and said grasping means includes a suction jet.

6. Plying machine in accordance with claim 2 wherein said guiding means includes:

a first guide means positioned near said transport means of said magazine, the grasping means of said first guide means including a stationary thread grasper for grasping the initial end of at least one thread of at least one of said reserve spools which follow the run-off spools in the magazine.

7. Plying machine in accordance with claim 1 wherein said guiding means includes:

a guide means positioned near said cutting means, the grasping means of said guide means including secondary thread graspers operable after operation of said cutting means for grasping each cut end of the original threads from said run-off spools.

8. Plying machine in accordance with claim 6 wherein said guiding means includes:

a second guide means positioned near said cutting means, the grasping means of said second guide means including secondary thread graspers operable after operation of said cutting means for grasping each cut end of the original threads from said run-off spools; and a third guide means positioned near said take-up spool the grasping means of said second guide means including a tertiary thread grasper for grasping the outer end of the doubled thread already on the take-up spool.

9. Plying machine in accordance with claim 8 comprising:

a common thread cleaner for cleaning the original threads and providing a cleaner signal, said cutting means, said combining means and said second and third guide means being automatically operated in response to said cleaner signals from said common thread cleaner.

* * * * *